US005975500A

United States Patent [19]

Orton et al.

[11] Patent Number: 5,975,500

[45] Date of Patent: Nov. 2, 1999

[54] CAST CONCRETE FENCE POSTS AND CAST CONCRETE BASES FOR SAID POSTS

[76] Inventors: Michael V Orton, 302 W. 100 S., Manti, Utah 84642; David S Orton, 301 S. 6th Ave., Princeton, Minn. 55371

[21] Appl. No.: 08/884,982

[22] Filed: Jun. 30, 1997

Related U.S. Application Data

[60] Provisional application No. 60/021,098, Jul. 2, 1996.

[51] Int. Cl.[6] ..... E04H 17/20

[52] U.S. Cl. ..... 256/19; 256/64

[58] Field of Search ..... 256/19, 89, 65, 256/64, 13.1, 38, 63, 10; 403/381; 52/298, 296, 297, 590.1, 590.2; 248/679, 678

[56] References Cited

U.S. PATENT DOCUMENTS

| | | | |
|---|---|---|---|
| 222,746 | 12/1879 | Snook | 256/63 |
| 240,843 | 5/1881 | Pontius | 403/381 |
| 265,846 | 10/1882 | McGee | 256/19 X |
| 332,141 | 12/1885 | Donaldson | 52/295 |
| 748,603 | 1/1904 | Henry | 52/590.1 |
| 868,838 | 10/1907 | Brewington | 52/604 X |
| 1,008,227 | 11/1911 | Welsz | 52/297 |
| 1,130,324 | 3/1915 | Owen | 403/381 X |
| 1,553,785 | 9/1925 | Ley | 52/297 |
| 3,451,657 | 6/1969 | Roberts | 256/19 |

FOREIGN PATENT DOCUMENTS

| | | | |
|---|---|---|---|
| 507031 | 11/1951 | Belgium | 52/297 |
| 691525 | 10/1979 | U.S.S.R. | 52/297 |
| 706498 | 1/1980 | U.S.S.R. | 52/296 |

*Primary Examiner*—Harry C. Kim
*Attorney, Agent, or Firm*—Jerry M. Crellin

[57] ABSTRACT

A fence post and support base are made of cast concrete. The base has a substantially planar bottom and an upper surface that is essentially parallel with the bottom of the base. The post extends substantially perpendicular from the upper surface of the base. The planar bottom surface of the base has a substantially larger area than the area encompassed by the interface between the post and the upper surface of the base so that the base provides a sturdy, support for the post. The base and the post are preferably cast as separate members, and a connecting mechanism is provided for interconnecting the post with the base.

2 Claims, 3 Drawing Sheets

CAST CONCRETE FENCE POSTS AND CAST CONCRETE BASES FOR SAID POSTS

BACKGROUND OF THE INVENTION

Related Application

This application claims the benefit of U.S. Provisional Application No. 60/021,098 filed on Jul. 2, 1996.

Field of the Invention

The present invention relates to cast concrete fence posts and associated cast concrete bases that are employed together with the cast concrete posts to construct a rail fence.

State of the Art

Fence posts made of cast concrete and which incorporate various means for attachment of fencing material thereto, including pins, bolts, nailable inserts cast integrally with the posts, are disclosed in U.S. Pat. Nos. 4,142,711; 4,519,586; and 4,824,077. A hollow cast concrete fence post that contains wire mesh reinforcing is disclosed in U.S. Pat. No. 3,933,969. In U.S. Pat. No. 3,890,751 there is disclosed a cast concrete block having a hole in the center of the block for receiving a fence post. The block is submerged in soil, and a fence post is inserted in the hole in the block so that the fence post stands erect. There is no disclosure or suggestion in U.S. Pat. No. 3,890,751 of using a cast concrete fence post in combination with the cast concrete block used as a base.

OBJECTIVES AND BRIEF DESCRIPTION OF THE INVENTION

A principal objective of the invention is to provide a fence post made of cast concrete, wherein (1) the post is elongate and can have a cross-sectional shape of a polygon, such as a rectangular, square, octagon, etc. or the cross-sectional shape can be curvilinear, such as round or oval, (2) the post has a longitudinal length of at least about 24 inches, and (3) the post has at least two spaced apart, substantially parallel openings extending from one side of the post to the other.

A further objective of the present invention is to provide such a fence post made of cast concrete in which the openings therein have a shape corresponding to the cross-sectional shape of the rails which are to be used so that (1) the ends of respective rails can be received in the openings to hold the rails firmly in place, (2) the rails will not wobble or rotate about their longitudinal axis.

A still further objective of the present invention is to provide such a fence post made of cast concrete in combination with a base made of cast concrete, wherein either (1) the base is cast integrally with the post or (2) the base and post have cooperating means for mounting the post in an upright position on the base.

The above objectives are achieved in accordance with the present invention by providing a novel cast concrete fence post and a cast concrete base member. The cast concrete post of the present invention comprises an elongate member having an elongate dimension of at least about 24 inches and a cross-sectional dimension of from about 4 inches to 8 or 10 inches. The cast concrete base is generally elongate member having a substantially planar bottom. The base is advantageously cast as an elongate, generally rectangular member having an upper surface that is essentially parallel with the bottom of the base. The base can also be cast in the form of a cross, i.e., having four legs extending outwardly from a common center portion. The bottom of the base again is substantially planar, and the upper surface is essentially parallel with the bottom.

The post and the base can be cast as an integral unit, however, because of the weight of such an integral unit, it is preferable to cast the post and base as separate members. Means are provided for mounting the post to the upper surface of the base. To provide stability to the post and base, it is advantageous to provide means for interconnecting the post with the base. For example, an indented receptacle can be formed in the upper surface of the base, and a corresponding projection is formed in the bottom surface of the post. The post is then set on the base so that the projection on the post engages and is received within the receptacle on the base. In an especially preferred embodiment, the receptacle on the base and the projection on the post form a dovetail connection that connects the post and the base together as an integral unit.

The post has at least two spaced apart, substantially parallel openings extending from one side of the post to the other. Advantageously, the openings in the post have a shape corresponding to the cross-sectional shape of the rails which are to be used so that the ends of respective rails can be received in the openings to hold the rails firmly in place so that the rails can not wobble or rotate about their longitudinal axis.

Additional objects and features of the invention will become apparent from the following detailed description, taken together with the accompanying drawings.

THE DRAWINGS

Preferred embodiments of the present invention representing the best modes presently contemplated of carrying out the invention are illustrated in the accompanying drawings in which.

DETAILED DESCRIPTION OF THE ILLUSTRATED EMBODIMENTS

Figure 1:
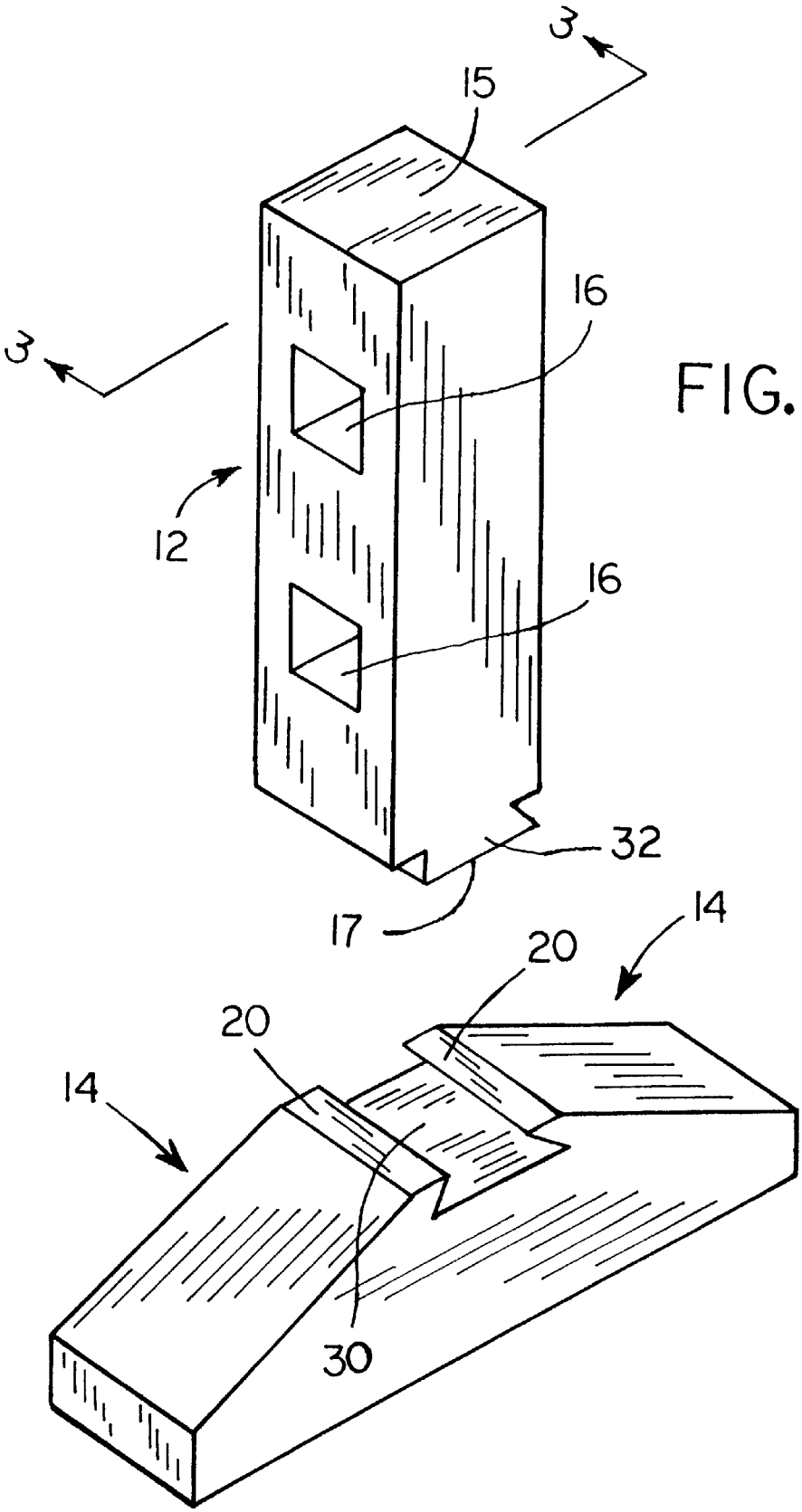
FIG. 1 is a pictorial representation of one preferred embodiment of a cast concrete post and associated cast concrete base showing the post in exploded relationship to the base.
Figure 2:
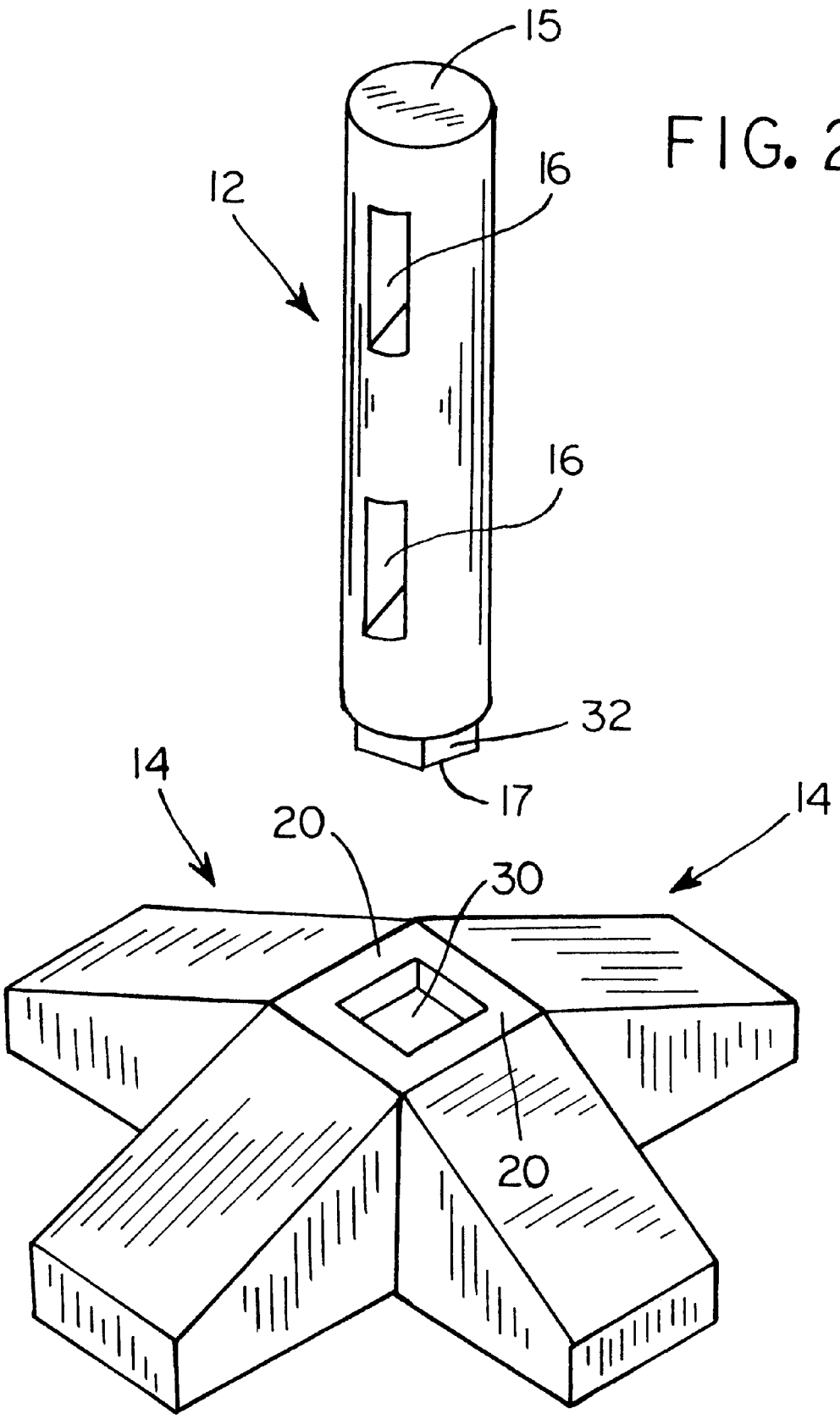
FIG. 2 is a pictorial representation similar to that of FIG. 1 showing a second preferred embodiment of a cast concrete post and associated cast concrete base, showing the base with four legs extending from a common center portion of the base.
Figure 3:
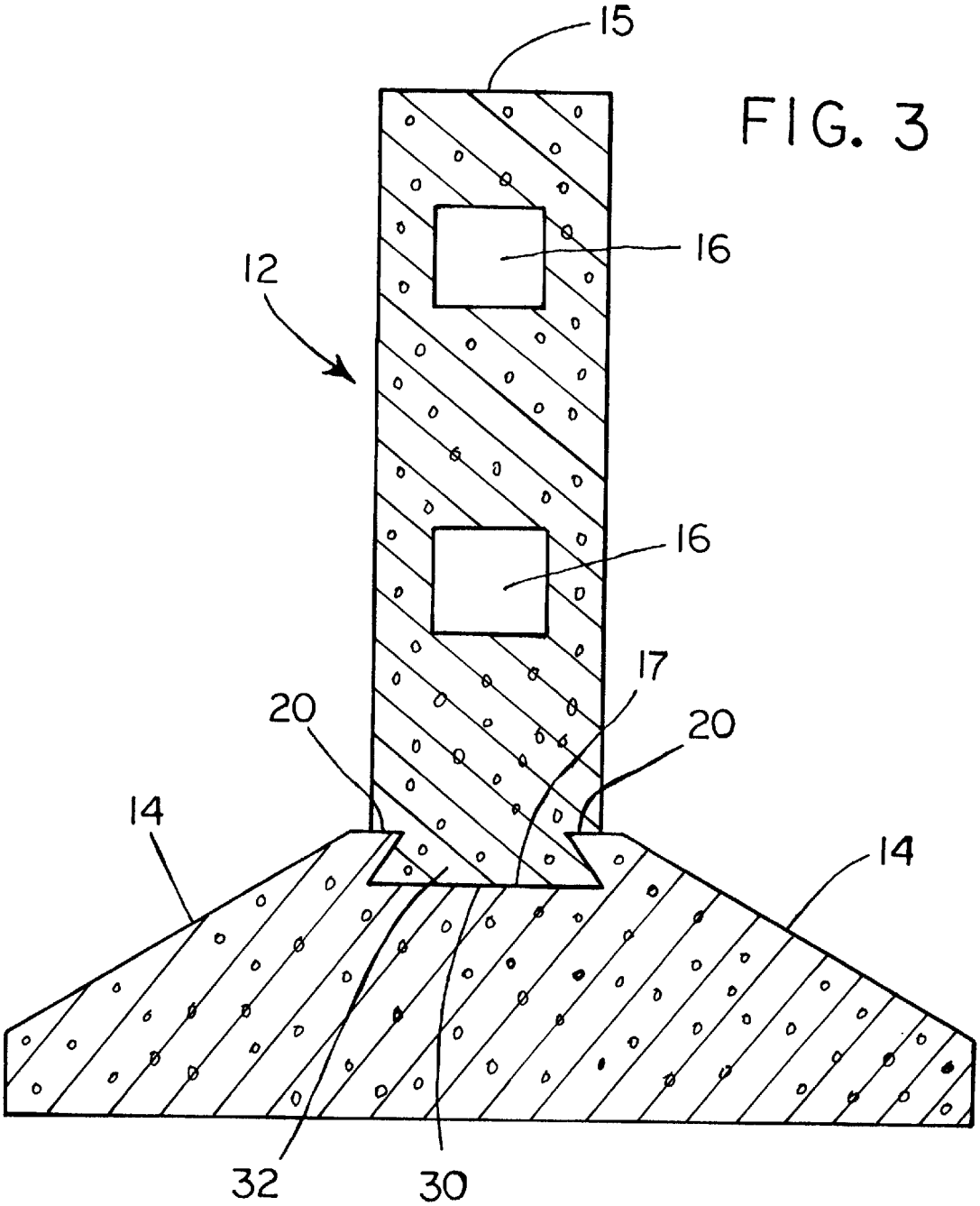
FIG. 3 is a cross section through the cast concrete post and cast concrete base of FIG. 1, showing the post in engagement with the base.

Referring now to FIGS. 1–3, two preferred embodiments of a cast concrete post 12 and associated cast concrete base 14 are illustrated. Like parts in each of the embodiments will be identified with the same reference numerals.

As illustrated, the cast concrete post 12 is elongate, having a longitudinal dimension of at least about 24 inches. In FIG. 1, the post 12 is shown having a substantially rectangular shape, and in FIG. 2, the post 12 is shown having a substantially round, cylindrical shape. It should be understood that the post 12 could have many shapes in addition to the rectangular and cylindrical shapes shown in the drawings. For example, the cross-sectional shape of the post 12 can be a polygon having various number of sides, or the cross-sectional shape of the post 12 can be of various curved shapes, such as oval.

The post 12 has at least two spaced apart, substantially parallel openings 16 that extend through the post 12 from one side thereof to the other. The openings 16 receive the ends of rails that are used to complete a fence. The rails are not shown in the drawings. The posts 12 have a cross-sectional dimension of from about 4 inches to about 8 or 10 inches. This allows sufficient space within each opening 16 for two abutting ends of aligned rails to be received and held in the opening 16 from opposite sides of the post 12 so that the abutting ends of the rails are supported by the post 12 with the rails extending diametrically in opposite directions from the post 12.

The openings 16 in the post 12 advantageously have a shape corresponding to the cross-sectional shape of the rails which are to be used on the particular fence. This allows the ends of respective rails to be received in the openings 16 while holding the rails relatively firmly in place so that the rails can not wobble, rotate or otherwise move within the openings 16.

As shown in FIGS. 1 and 3, the openings 16 are essentially square and sized to accept a square rail or a common landscape timber that is commercially available and which has two flat sides and two curved sides. The flat sides of a common landscape timber slide in the opening 16 in sliding contact with a first set of opposite sides of the opening 16, and the apex of the curved portions of the other two sides of the landscape timber slide into the opening 16 making sliding contact with a second set of opposite sides of the opening 16. A square rail is received in the opening 16 of the post shown in FIGS. 1 and 3 so that each side of the square rail makes sliding contact with a respective side of the opening 16.

As shown in FIG. 2, the openings 16 are essentially rectangular and sized to accept a specific size of rail. For nominal 1×6 rails, the openings 16 would have a dimensions of about 0.75 inches by 5.75 inches. For nominal 1×4 rails, the openings 16 would have dimensions of about 0.75 inches by 3.75 inches. For nominal 2×4 rails, the openings 16 would have dimensions of about 1.75 inches by 3.75 inches. The rails would slide into the openings so that opposite pairs of sides of the rails would make sliding contact with respective opposite pairs of sides of the openings 16.

The base 14 is cast in such a shape and of such a size as to provide a sturdy, steady support for a respective post 16. As shown in FIGS. 1 and 3, the base 14 advantageously is cast as an elongate, generally rectangular member having an upper surface 20 that is essentially parallel with the bottom 22 of the base 14. For decorative purposes, the top of the base 14 can be formed with two downwardly sloping surfaces that extend from a central portion of the base 14. The central portion forms the upper surface 20. The upper surface must be of a size that will accommodate the resting of the lower end of the post 12 on the upper surface 20. As shown in FIG. 2, the base 14 is provided with an additional pair of legs extending from the central portion of the base 14 such that the base 14 has four legs extending outwardly form the common center portion. The bottom 22 of all the legs are again essentially planar. Again for decorative purposes, the top of the base 14 can be formed with downwardly sloping surfaces on each of the legs, with the downwardly sloping surfaces extending from a central portion of the base 14. An upper surface 20 is provided on the central portion, with the upper surface being substantially the same as the upper surface 20 of the base 14 shown in FIGS. 1 and 3.

The bottom surface of the base 14 is adapted to rest against the ground or a paving such as concrete or blacktop. When the base 14 is to be set on the ground, it is advisable to excavate the ground so as to provide a level layer of gravel or other such material on the surface of the ground, with the bottom surface of the base being in contact with the layer of gravel or other such material. Of course, the base 14 can be submerged in the ground to any degree if so desired. The only restriction being that the upper surface 20 of the base 14 must be exposed so as to receive the post 12.

One of the advantages of the present invention is that a temporary fence can be quickly assembled and disassemble on a paved area such as a parking lot. The bases 14 can be placed directly on a paved area, and with the use of the posts 12, a fence can quickly be laid out to separate a portion of the parking lot from the rest of the parking lot. As illustrated, the cast concrete post 12 comprises an elongate, solid block having a substantially planar top face 15 and a substantially planar bottom face 17 that is spaced from the top face 15, with the bottom face 17 and bottom face 15 being substantially parallel to each other.

The post 12 and base 14 could be cast as an integral unit. Because such a unitary member would be bulky and worse very heavy, it is preferable to cast the post 12 and base 14 as separate members. It is desirable to provide means for connecting the post 12 and base 14 to approach the stability that would be obtained by casting them as an integral unit. In accordance with the present invention, means are provided for mounting the post 12 to the upper surface 20 of the base 14. A stable mounting of the post 12 to the base 14 can be provided by means for interconnecting the post 12 with the upper surface 20 of the base 14. Advantageously, an indented receptacle 30 is formed in the upper surface 20 of the base 14, and a corresponding projection 32 is formed in the bottom surface of the post 12. Although not being illustrated in the drawings, it should be recognized that these roles could be reversed, i.e., the receptacle 30 could be formed in the bottom surface of the post 12, with the corresponding projection 32 being formed in the upper surface 20 of the base 14.

In the embodiment shown in FIGS. 1 and 3 of the drawings, the indented receptacle 30 is formed by a broad, flat, relatively shallow trough or channel that extends across the face of the upper surface of the base 14. The longitudinal sides of the trough or channel are formed so that they slant away from the longitudinal center line of the trough or channel. The bottom of the post 12 has an elongate projection 32 whose projecting end forms a substantially broad, planar face that matches the shape of the bottom face of the trough or channel of the indent ed receptacle 30 on the base 14. The longitudinal sides of the projection 32 on the post are formed so that they slant away from the longitudinal center line of the projection 32, so that these sides dovetail with the sides of the receptacle 30 when the projection 32 is slid into the receptacle 30 as best shown in FIG. 3. The dovetailed sides of the receptacle 30 and projection 32 tie the post 12 and base 14 together in essentially an integral unit and in fact provide all the stability that would be achieved by in fact casting the post 12 and base 14 as an integral unit.

In the embodiment shown in FIG. 2, the receptacle 30 has sides that are essentially perpendicular to the upper surface 20 of the base 14. As illustrated, the receptacle 30 of the embodiment of FIG. 2 does not extend across the full width of the base 14. It has four sides and is thus a closed well. It should be recognized however that the receptacle 30 of the embodiment of FIG. 2 could extend across the full width of the base 14 similar to the embodiment of FIGS. 1 and 3. The projection 32 on the bottom surface of the post 12 in the embodiment of FIG. 2 has a rectangular shape that is adapted to fit into the receptacle 30 of the base 14. Mechanical means can be used to hold the projection 32 in engagement with the receptacle 30. The mechanical means can be an adhesive or setting compound (quick setting cement) that is applied to the projection 32 when the projection is set in the receptacle 30. Instead of an adhesive or setting compound a wedge element can be inserted between the sides of the projection 32 and the receptacle 30 to hold the two securely together.

It should be recognized that an adhesive or setting compound could be used in mounting the projection 32 and receptacle 30 of the embodiment of FIGS. 1 and 3. However, if the dovetails of the embodiment of FIGS. 1 and 3 are fairly tight, no additional mechanical means is needed to lock the projection 32 on the post 12 to the receptacle 30 on the base 14.

The post 12 and base 14 of the present invention can be provided with a variety of textures on its surface. In addition, the post 12 and base 14 can be made in a wide variety of colors, and as mentioned previously, the shape of the post 12 and base 14 can also be varied. A variety of rail sizes and materials can be used as the rail portion of the fence.

The cast concrete posts 12 and bases 14 of the present invention provide many advantages. There is no extensive excavation and digging necessary to anchor the bases 14 and posts 12. At most, when the fence is being installed on soil or sod, a shallow, broad bed of gravel or crushed rock is needed on which each base 14 sets. The bed need only be 2 inches larger in footprint than the size of the bottom of the base 14, with the bed being between 2 inches and 4 inches in depth. There is no necessity to dig a deep post hole or to pour concrete footings. The fence can quickly and easily be installed by a do-it-yourselfer rather than a professional. When the fence is installed on a paved surface such as a parking lot, no preparation of the paved surface is necessary. The bases 14 are simply set directly on the paved surface.

The posts 12 and bases 14 of the present invention are durable and stable. The concrete material will not rot, and the bases 14 provide good stability to the fence to prevent the fence from tipping or sagging in any direction.

When maintenance is required, components of the fence can be quickly and easily replaced. The fence is portable, and either during installation or after, if it is necessary to change the alignment or position of the fence, the posts 12 and bases 14 can be readily moved to the new position.

We claim:

1. A combination of a cast concrete fence post and cast concrete support base comprising said post having at least two spaced apart, substantially parallel openings extending from one side of said post to the other side of said post;

said base having a substantially planar bottom and an upper surface that is essentially parallel with said bottom of said base;

said post extending substantially perpendicular from said upper surface of said base;

said base and said post are cast as separate members;

an indented receptacle is formed in the upper surface of said base, with said indented receptacle extending across an entire width of said upper surface of said base so that said indented receptacle has opposite sides each of which has a length that is substantially the same as the width of said upper surface of said base;

a corresponding projection formed in a bottom surface of said post, with said projection in said bottom surface of said post having a size and shape that is received in engagement with said indented receptacle, with opposite sides of said projection extending along and abutting the entire length of said opposite said of said indented receptacle; and means for interlocking the opposite sides of said indented receptacle with the opposite sides of said projection to securely attach said post to said base.

2. The combination cast concrete fence post and cast concrete support base in accordance with claim 1 wherein the indented receptacle and said corresponding projection form a dovetail.

* * * * *